US006597312B1

(12) United States Patent
Hrycak

(10) Patent No.: US 6,597,312 B1
(45) Date of Patent: Jul. 22, 2003

(54) PHASED ARRAY ANTENNA SYSTEM GENERATING MULTIPLE BEAMS HAVING A COMMON PHASE CENTER

(75) Inventor: Peter D. Hrycak, Severna Park, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/058,336

(22) Filed: Jan. 30, 2002

(51) Int. Cl.[7] ..... H01Q 3/24

(52) U.S. Cl. ..... 342/372; 342/81; 342/373

(58) Field of Search ..... 342/81, 154, 157, 342/372, 373

(56) References Cited

U.S. PATENT DOCUMENTS

| | | | | |
|---|---|---|---|---|
| 5,079,557 A | * | 1/1992 | Hopwood et al. | 342/373 |
| 5,283,587 A | * | 2/1994 | Hirshfield et al. | 342/372 |
| 5,389,939 A | | 2/1995 | Tang et al. | |
| 5,512,900 A | * | 4/1996 | Parkin et al. | 342/35 |
| 5,784,022 A | | 7/1998 | Kupfer | |

* cited by examiner

*Primary Examiner*—Dao Phan
(74) *Attorney, Agent, or Firm*—Birch, Stewart, Kolasch & Birch, LLP

(57) ABSTRACT

An electronically scanned phased array antenna system which utilizes phase-only control in the generation of multiple beams simultaneously and having a coincident or common phase center so that the entire aperture is used to radiate available RF energy, thus using all of the RF power that the aperture can radiate.

18 Claims, 4 Drawing Sheets

FIG. 1
PRIOR ART
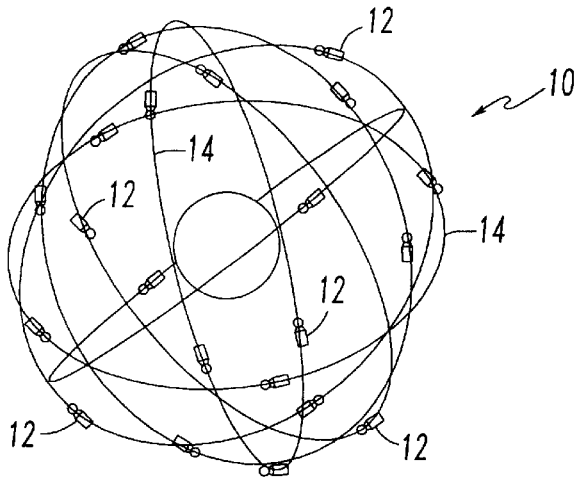
FIG. 2
PRIOR ART
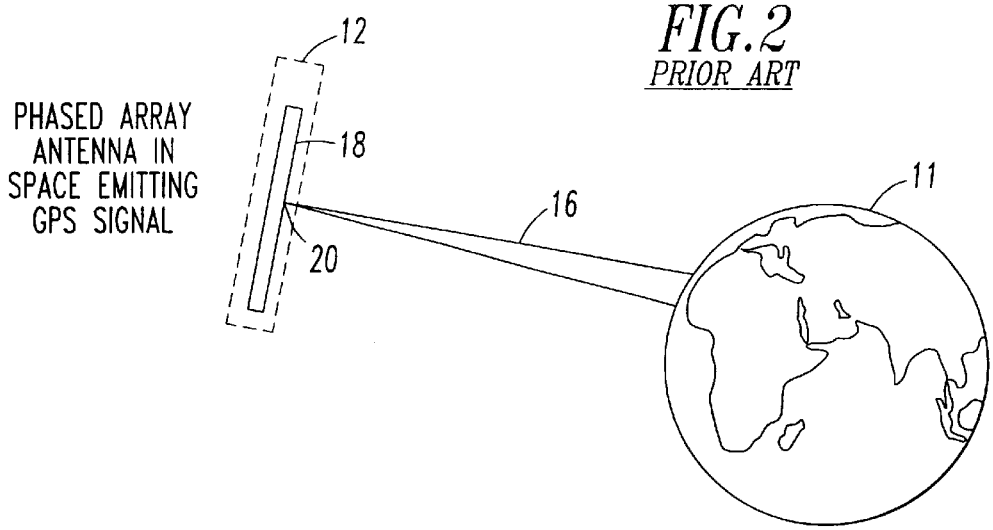
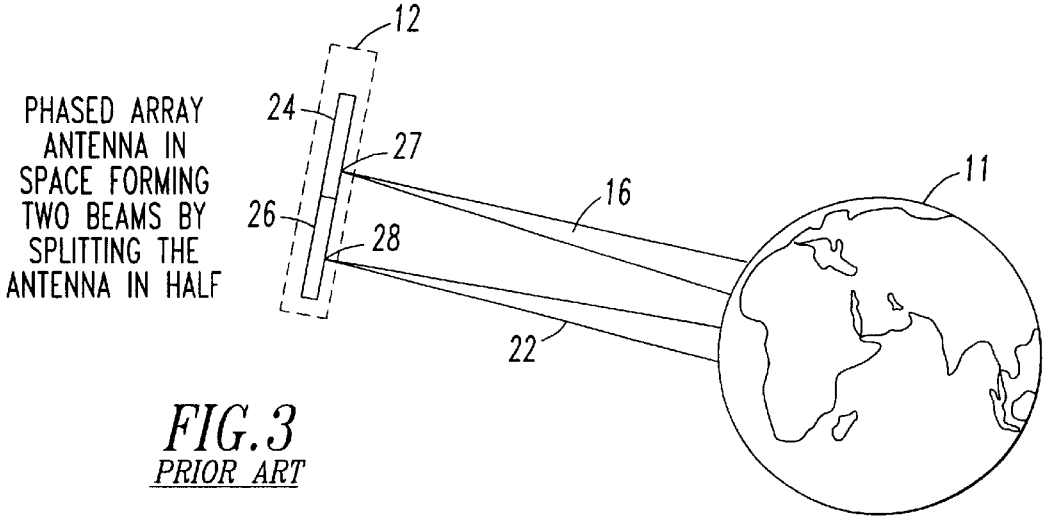
FIG. 3
PRIOR ART

PHASED ARRAY ANTENNA SYSTEM GENERATING MULTIPLE BEAMS HAVING A COMMON PHASE CENTER

BACKGROUND OF THE INVENTION

1. Field of the Invention

This invention relates generally to phased array antennas generating one or more beams simultaneously and, more particularly, to a phased array antenna for simultaneously generating multiple beams having a common phase center using phase-only control.

2. Description of Related Art

RF transmit systems having the capability of covering two or more areas of operation simultaneously with the same information are generally well known. Examples of such systems include: navigational systems, such as the emerging GPS-III global positioning system, where improved accuracy is achieved by illuminating two different areas of operation with a tight beam at enhanced RF power levels; communications systems that are required to concurrently relay the same information to two or more locations; and, electronic warfare (EW) systems having capability of simultaneously jamming multiple hostile sites.

Navigational systems, such as the GPS-III system, require that the phase center be maintained whether a single or multiple beam mode of operation is in place.

Where such systems include an electronically scanned array (ESA), the antenna is typically divided into two or more sub-arrays that implement separate apertures, each covering a given area of operation. For a two beam system, a −3 dB aperture penalty is paid as well as a 3 dB radiated power penalty that totals 6 dB in degradation. Moreover, a coincident phase center for the mobile beams is lost by the separation of the antenna into separate sub-arrays due to the fact that the beam generated by each sub-array has its own phase center. This separation of phase centers limits the accuracy obtainable, particularly when used in a global positioning system.

SUMMARY

Accordingly, it is an object of the present invention to provide an improvement in electronically scanned arrays, such as phased array antennas.

It is another object of the present invention to provide an improvement in phased array antennas generating and radiating two or more RF signals.

It is a further object of the present invention to optimize the effective radiated power of a phased array antenna system.

It is another object of the invention to provide a phased array antenna which improves accuracy in a navigational or global positioning system.

These and other objects are achieved by an electronically scanned phased array antenna system which utilizes phase-only control in the generation of multiple beams simultaneously having a coincident or common phase center so that the entire aperture is used to radiate available RF energy, thus using all of the RF power that the aperture can radiate.

In one aspect of the invention, it is directed to a method of simultaneously generating two or more beams of RF energy for transmission by an array of radiator elements of a phased array including respective RF signal phase shifters coupling RF energy to each element of the array, comprising the steps of: generating respective phase control signals for each phase shifter associated with each radiator element of the array in response to a direction command for generating a separate phase front for each beam of said two or more beams; combining the respective phase control signals for each said radiator element for each beam of said two or more beams so that the phase fronts have a common phase center; coupling only the phase information resulting from combining the respective phase controlled signals for each said radiator element for each beam of said two or more beams so that the phase fronts have a common phase center to respective phase shifters associated with each of the radiators of the array for steering the phase fronts of the beams in respective predetermined directions.

In another aspect of the invention, it is directed to a phased array antenna system for simultaneously generating at least two beams of RF energy having a common phase center by phase-only control, comprising: an RF signal source; a plurality of radiator elements arranged in an array; a beamformer network coupling the RF signal source to the plurality of radiator elements; respective RF phase shifters coupled between the beamformer network and each radiator of said plurality of radiator elements for varying the respective phase of an RF signal radiated from the radiator elements; a source of direction command signals; and beam steering circuitry including, means for generating phase control signals for each of the respective phase shifters in response to a direction command signal generated by said source of direction command signals for generating a separate phase front for each of said beams and wherein the phase fronts have a common phase center, means for combining the respective phase control signals for each of the phase shifters for each of said beams so as to form composite phase control signals for each of said radiator elements, and means for setting the amplitudes of the composite phase control signals so as to be substantially equal, said composite phase control signals of substantially equal amplitude being coupled to said phase shifters so as to provide phase-only steering of said beams simultaneously in respective predetermined directions from the same radiator elements.

Further scope of applicability of the present invention will become apparent from the detailed description provided hereinafter. It should be understood, however, that the detailed description and specific example, while disclosing the preferred embodiment of the invention, is provided by way of illustration only, since various changes and modifications coming within the spirit and scope of the invention will become apparent to those skilled in the art.

BRIEF DESCRIPTION OF THE DRAWINGS

The present invention will become more fully understood when the detailed description, provided hereinafter, is considered in conjunction with the accompanying drawings, which are provided by way of illustration only, and wherein:

FIG. 1 is a diagram illustrative of a multi-satellite constellation global positioning system (GPS) in accordance with the known prior art;

FIG. 2 is a diagram of a phased array antenna in space emitting a GPS signal to the earth in a single beam in accordance with the known prior art;

FIG. 3 is a diagram illustrative of a phased array antenna in space forming and emitting two GPS signal beams where the antenna is divided in half so as to provide two sub-arrays having separate phase centers in accordance with the known prior art;

DETAILED DESCRIPTION OF THE INVENTION

Figure 4:
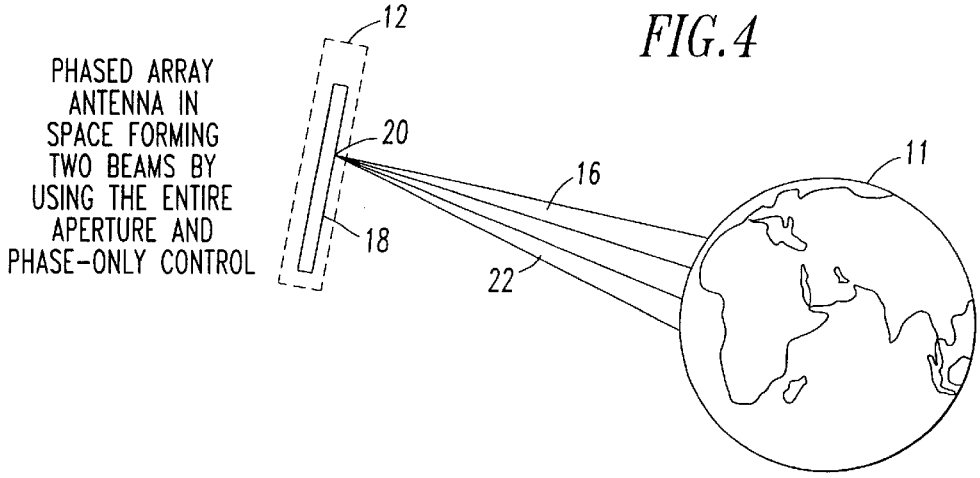
FIG. 4 is illustrative of a phased array antenna in space forming two beams in accordance with the subject invention.

Referring now to the drawings wherein like reference numerals refer to like components throughout, reference is first made to FIG. 1 where there is shown a global positioning system 10, for example, a spaced based navigational system such as the GPS-III system and one employing a constellation of 24 satellites (nominal) in six orbital planes 14 around the earth, with four satellites 12 in each plane. The orbits 14 comprise semi-synchronous orbits located at a distance, for example, 11,000 miles above the earth so that whole earth beam coverage is provided. Knowledge of satellite positions and more particularly the antenna beam phase centers thereof determines the system's navigational accuracy obtainable.

Turning attention now to FIG. 2, shown thereat is an area of the earth irradiated by a GPS signal beam 16 emanating from a phased array antenna 18 located in a satellite 12, for example, one of the satellites shown in FIG. 1. As shown, the beam 16 emanates from a phase center 20 at the center of the array.

In accordance with the prior art, where there is a requirement for forming, for example, two beams 22 by the phased array antenna 18, the two beams 16 and 22 are typically formed by splitting the antenna 18 in half, thereby providing two separate sub-arrays 24 and 26, having respective phase centers 27 and 28. In such a configuration, each beam 16 and 22 suffers a ½ antenna gain loss or aperture penalty of −3 dB and a ½ radiated power loss or power penalty −3 dB which results in a ¼ performance loss or 6 dB in degradation. The two separate phase centers 27 and 28, moreover, impact navigational accuracy on the earth equivalent to ½ the antenna size, typically about 8.5 feet in a GPS-III navigational system.

Referring now to the subject invention and more particularly to FIG. 4, shown thereat is a phased array antenna 18 in space which forms two beams 16 and 22 simultaneously while having a single common phase center 20. In such a configuration, the entire aperture of the antenna 18 is used to radiate all of the RF available energy. Moreover, each beam 16 and 22 suffers only a ½ efficiency loss or aperture efficiency penalty −3 dB plus any loss penalty due to systematic errors. Such an arrangement results in substantially a 50% improvement in performance over the prior art such as shown in FIG. 3. Thus instead of paying a 6 dB effective radiated power (ERP) penalty, the present aperture illumination efficiency penalty is in the order of 4 dB, i.e., −3 dB less in aperture efficiency plus about −0.8 dB in systematic errors. Thus a significant improvement in performance is achieved over the prior art. Moreover, the single phase center 20 provides a significant increase in navigational accuracy which is crucial for present day and future GPS navigation systems.

Figure 5:
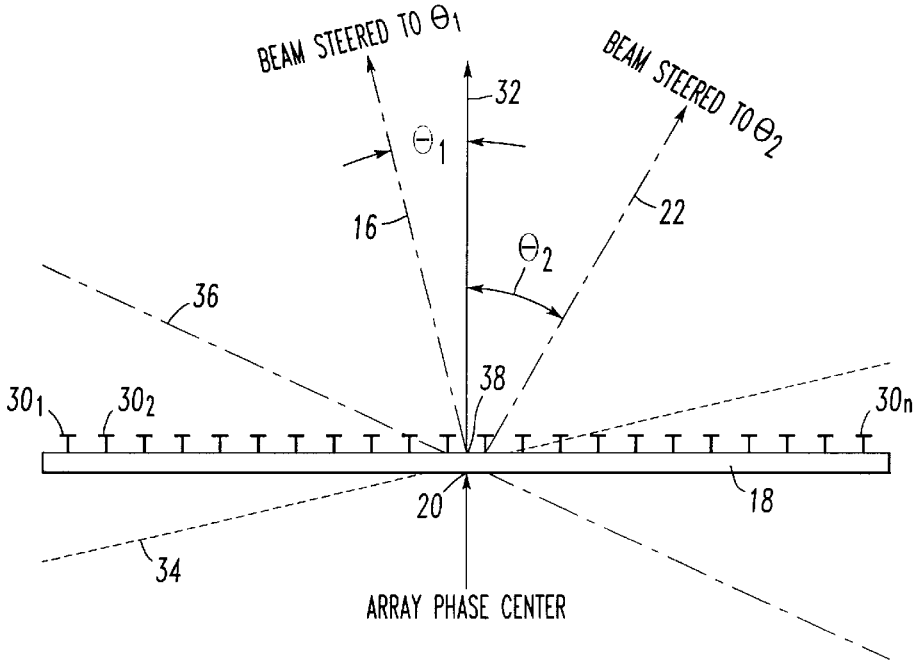
FIG. 5 is a diagram of the phased array antenna, shown in FIG. 4, wherein two beams are formed by using the entire aperture while having a common phase center.

Referring now to FIG. 5, shown thereat is a linear array 18 including, for example, a plurality n of antenna elements $\mathbf{30}_1, \mathbf{30}_2 \ldots \mathbf{30}_n$, typically n=36, from which the same signal information is transmitted in the two beams 16 and 22 respectively, steered to an angle $\theta_1$ and $\theta_2$ relative to boresight 32, which is in a direction orthogonal to the array at the center 38 thereof shown in FIG. 5 which is also the array phase center 20. In order to form the two beams 16 and 22, respective planar phase fronts 34 and 36 are generated so as to steer the beams in the directions shown. Moreover, to maintain the same phase center 20 for the two beams 16 and 22, the progressive phase fronts 34 and 36 emanate from the center 38 of the array 18 which is shown coincident with boresight 32.

Figure 6:
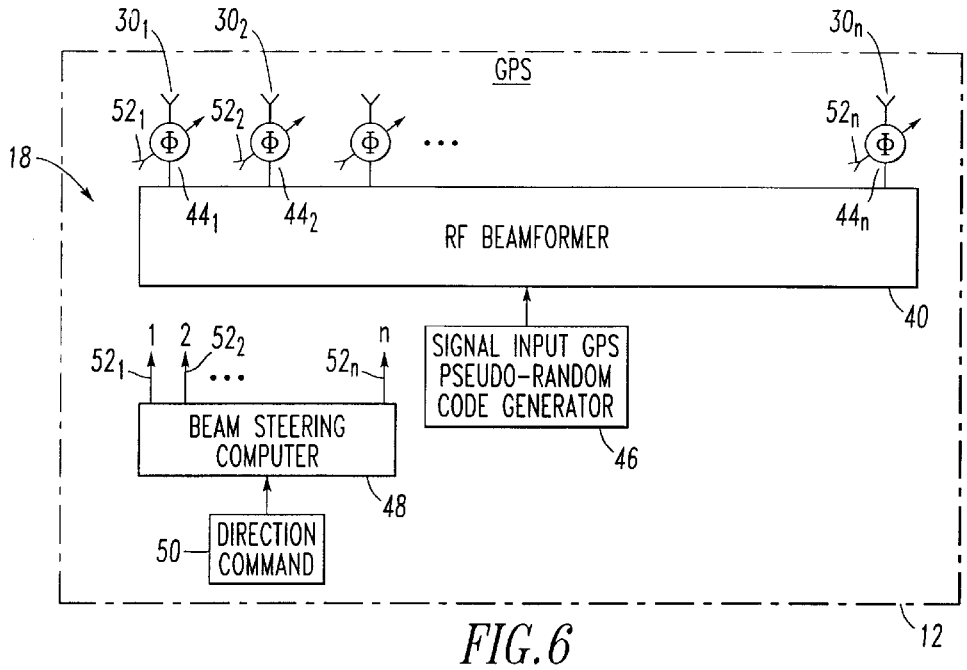
FIG. 6 is an electrical block diagram illustrative of the preferred embodiment of the invention for generating the beams shown in FIG. 5.

Apparatus for generating the two beams 16 and 22 simultaneously while having a common phase center 20 is shown in FIG. 6. Referring now to FIG. 6, shown thereat is an array 18 consisting of n radiating elements $\mathbf{30}_1, \mathbf{30}_2 \ldots \mathbf{30}_n$, coupled to an RF beamformer network 40 via respective RF phase shifters $\mathbf{44}_1, \mathbf{44}_2 \ldots \mathbf{44}_n$. The RF beamformer 40 distributes the amplitude of an RF signal to be transmitted in response to the output of a GPS pseudorandom code generator 46 in a manner well known to those skilled in the art. The phase shifters $\mathbf{44}_1, \mathbf{44}_2 \ldots \mathbf{44}_n$ are controlled by a beam steering computer 48 which generates n phase control signals in response to an input from a direction command signal generator 52 and which are coupled to the phase shifters, for example, via signal leads $\mathbf{52}_1, \mathbf{52}_2 \ldots \mathbf{52}_n$ which steers the beam.

Super position dictates in the conservation of energy that one-half of the power will go into one beam, while the other half of the power will go into the other beam. Therefore, the best possible aperture efficiency that can be achieved is −3 dB. The beam steering computer 48 calculates the phase fronts for the radiators $\mathbf{30}_1 \ldots \mathbf{30}_n$ to form beams 16 and 22, as shown in FIG. 5. Complex phase voltages are computed and vectorially added in the beam steering computer 48 forming a composite phase control signal for each phase shifter associated with each radiator element. The amplitude of the composite phase control signals, moreover, are controlled so as to be substantially equal. Normally, both phase and amplitude would be modified at the radiator element to form two simultaneous beams. However, in the subject invention, the amplitude of the signal at the radiator elements is left unmodified, and only the relative phase of the signal is used to form the two simultaneous beams.

Figure 7:
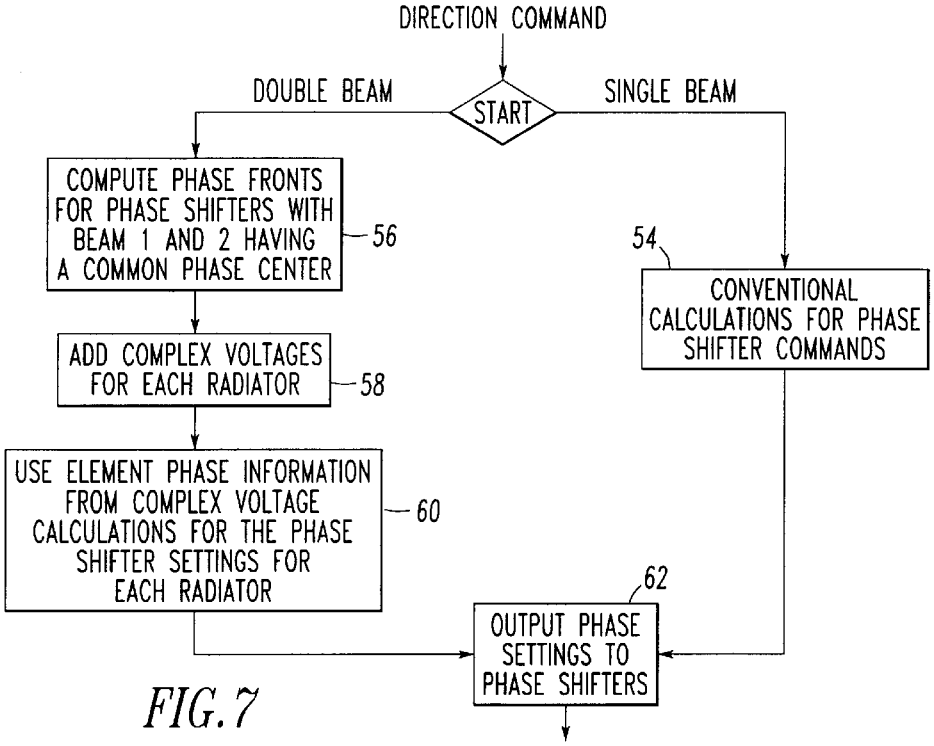
FIG. 7 is a flow chart illustrative of the method for generating the beams shown in FIG. 5.

This procedure is shown in the flowchart of FIG. 7 where, in response to a direction command, a single beam generation simply involves the use of conventional calculation for phase shifter commands as shown in step 54. However, where two beams are to be generated having a common phase center, a first step 56 is carried out in the beam steering computer 48 shown in FIG. 6, which computes the complex voltages for each of the radiating elements $\mathbf{30}_1, \mathbf{30}_2 \ldots \mathbf{30}_n$ for each beam to be formed. This is followed by adding the complex phase front voltages for each radiator for the two beams as shown by step 58. Since the RF amplitude of the signals at each radiator are set by the RF beamformer 40, the beam steering computer 48 outputs only the phase settings to the phase shifters as shown by step 52.

Figure 8:
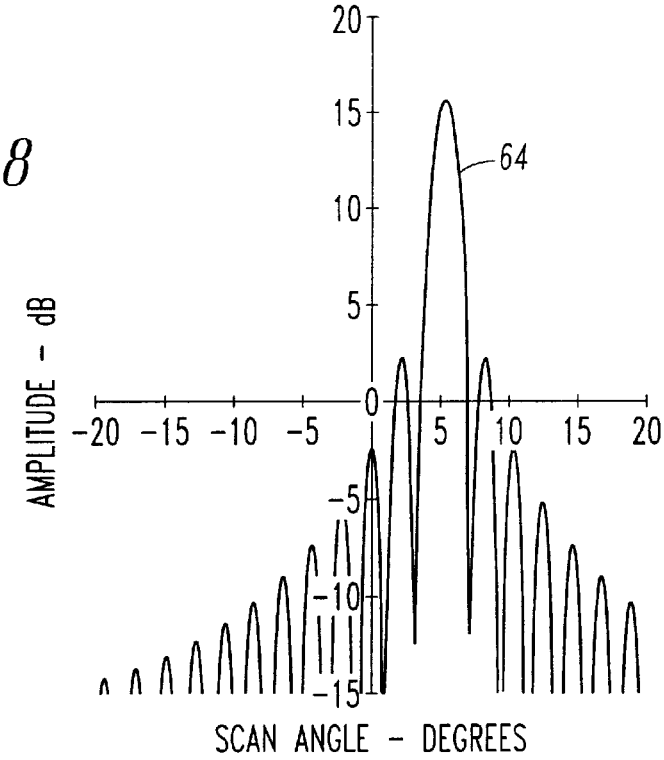
FIG. 8 is illustrative of an antenna beam pattern for a single beam generated by the subject invention.
Figure 9:
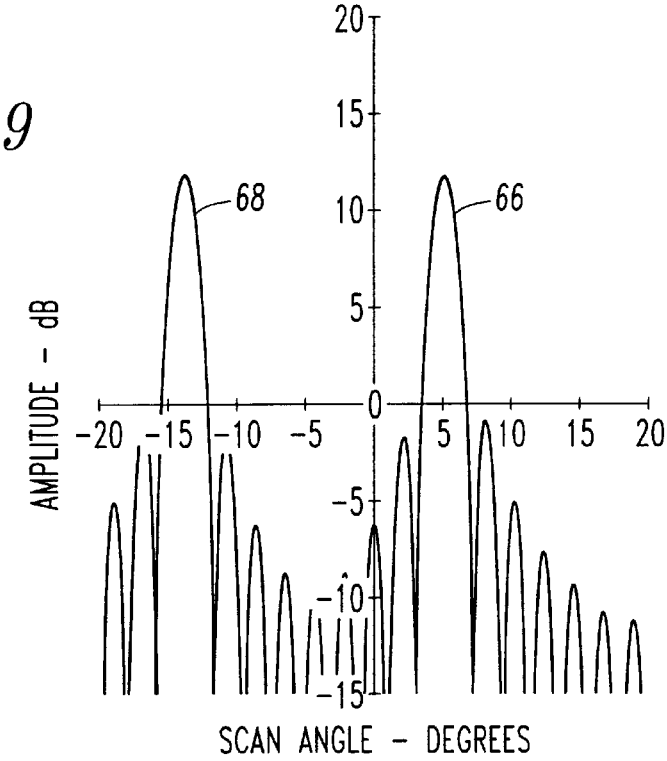
FIG. 9 is illustrative of an antenna pattern where two beams are generated simultaneously in accordance with the subject invention.

Assuming, for example, that an n=36 element array is commanded to generate and steer a single beam 16 such as shown in FIG. 2 to 5°, an illustrative example of a beam pattern is shown in FIG. 8 where the main lobe 64 having an amplitude, for example, 15 dB is generated at a scan angle of 5°. Where, however, two beams 16 and 22 having a common phase center 20, such as shown in FIGS. 4 and 5, are generated in accordance with the subject invention and steered to 5° and −14.3° using phase-only control, beam patterns such as shown in FIG. 9 including main lobes 66 and 68 are generated.

As can be seen, a −3 dB reduction in amplitude occurs, when two simultaneous beams 16 and 22 are formed. After an additional −0.8 dB hit occurs because of systematic errors, a −3.8 dB ER penalty is incurred as compared to a −6 dB ER penalty that would be incurred if the array were to be split into two sub-arrays as shown in accordance with the prior art (FIG. 3). In the present invention, however, a common phase center 20 is maintained for both beams 16 and 22 (FIGS. 4 and 5).

Accordingly, the only parameter that is changed is the phase of the RF signal. The phase of the RF signal radiated from the radiating elements $\mathbf{30}_1 \ldots \mathbf{30}_n$ is controlled by the phase shifters $\mathbf{44}_1 \ldots \mathbf{44}_n$ which in turn are controlled by the beam steering computer 48. The beam steering computer, when commanded to form two beams 16 and 22, performs a calculation for the complex voltage which would be needed for each radiating element $\mathbf{30}_1 \ldots \mathbf{30}_n$. However, it can only change the phase state at the radiating element by means of the phase shifter $\mathbf{44}_1 \ldots \mathbf{44}_n$. By using only the phase from the computation, two beams 16 and 22 having a common phase center can be formed.

Although the subject invention has been disclosed for a condition where uniform transmitted illumination is provided, the same can be achieved if the array has a fixed transmit taper; however, such an approach would require careful attention to systems that require low sidelobes.

The foregoing detailed description merely illustrates the principles of the invention. It will thus be appreciated that those skilled in the art will be able to devise various arrangements which, although to explicitly described or shown herein, embody the principles of the invention and are thus within its spirit and scope.

What is claimed:

1. A method of simultaneously generating two or more beams of RF energy for transmission by an array of radiator elements of a phased array including respective RF signal phase shifters coupling RF energy to each element of the array, comprising the steps of:

(a) generating respective phase control signals for each radiator element of the array in response to a direction command for generating a separate phase front for each beam of said two or more beams;

(b) combining the respective phase control signals for each said radiator element for each beam of said two or more beams so that the phase fronts have a common phase center;

(c) coupling only the phase information resulting from step (b) to respective phase shifters associated with each of the radiators of the array for steering the phase fronts of the beams in respective predetermined directions.

2. The method of claim 1 wherein the phase control signals comprise complex voltage signals.

3. The method of claim 2 wherein the step (b) of combining comprises vectorially adding the complex voltage signals.

4. A method of simultaneously generating and transmitting two or more beams of RF energy by phase-only control for transmission by a plurality of radiator elements of a phased array, comprising the steps of:

(a) computing respective complex phase control signals for each radiator element of the phased array in response to a direction command for generating a separate phase front for each beam of said two or more beams and wherein said phase fronts have a common phase center;

(b) vectorially adding the respective complex phase control signals;

(c) controlling the amplitudes of all the added phase control signals so as to be substantially equal;

(d) applying phase control signals to respective phase shifters associated with each of the radiators of the array for steering the phase fronts of the beams in respective predetermined directions; and (e) radiating each of the beams simultaneously from the same radiator elements.

5. The method of claim 4 wherein step (e) includes radiating each of the beams simultaneously from all of the radiator elements.

6. The method of claim 4 wherein said phased array comprises a linear or planar array.

7. The method of claim 4 wherein all of the beams emanate from the center or mid-point of the array.

8. A phased array antenna system for simultaneously generating at least two beams of RF energy having a common phase center by phase-only control, comprising:

an RF signal source;

a plurality of radiator elements arranged in an array;

a beamformer network coupling the RF signal source to the plurality of radiator elements; respective RF phase shifters coupled between the beamformer network and each radiator of said plurality of radiator elements for varying the respective phase of an RF signal radiated from the radiator elements;

a source of direction command signals; and beam steering circuitry including, means for generating phase control signals for each of the radiator elements in response to a direction command signal generated by said source of direction command signals for generating a separate phase front for each of said beams and wherein the phase fronts have a common phase center, and means for combining the respective phase control signals so as to form composite phase control signals for each of said radiator elements, said composite phase control signs of substantially equal amplitude being coupled to said phase shifters so as to provide phase-only steering of said beams simultaneously in respective predetermined directions from the same radiator elements.

9. The system of claim 8 wherein said beam steering circuitry includes means for setting the amplitudes of the composite phase control signals so as to be substantially equal.

10. The system of claim 9 wherein said phase control signals comprise complex phase voltage signals.

11. The system of claim 10 wherein said means for combining the respective phase control signals comprises means for vectorially adding the complex phase voltage signals.

12. The system of claim 11 wherein all of the radiator elements are used to commonly radiate each of said beams, thereby using all of the RF power that the array can radiate.

13. The system of claim 12 wherein the array of radiator elements comprises a linear array or a planar array.

14. The system of claim 13 wherein each of said beams commonly radiate from a mid-point of the array.

15. The system of claim 8 wherein the beam steering circuitry comprises a beam steering computer.

16. The system of claim 8 wherein the RF signal source comprises a source of GPS signals.

17. The system of claim 16 wherein said source of GPS signals includes a code generator.

18. The system of claim 17 wherein said code generator comprises a GPS pseudo-random code generator.

* * * * *